US007896130B2

(12) United States Patent
Hill et al.

(10) Patent No.: US 7,896,130 B2
(45) Date of Patent: Mar. 1, 2011

(54) SNAP ACTION VALVE WITH INERTIA DAMPER

(75) Inventors: William E. Hill, Ann Arbor, MI (US); Jordan Sahs, Grass Lake, MI (US); Jason Lefler, Brooklyn, MI (US)

(73) Assignee: Tenneco Automotive Operating Company Inc., Lake Forest, IL (US)

( * ) Notice: Subject to any disclaimer, the term of this patent is extended or adjusted under 35 U.S.C. 154(b) by 0 days.

(21) Appl. No.: 12/470,560

(22) Filed: May 22, 2009

(65) Prior Publication Data

US 2010/0294589 A1 Nov. 25, 2010

(51) Int. Cl.

| | |
|---|---|
| ***F01N 1/00*** | (2006.01) |
| ***F01N 1/02*** | (2006.01) |
| ***F01N 1/08*** | (2006.01) |
| ***F01N 1/16*** | (2006.01) |
| ***F01N 13/02*** | (2006.01) |
| ***F02B 47/08*** | (2006.01) |
| ***F16F 7/10*** | (2006.01) |

(52) U.S. Cl. ..... 181/254; 181/232; 181/236; 181/237; 181/251; 181/264; 60/324; 123/568.18; 188/378

(58) Field of Classification Search ..... 181/254, 181/232, 237, 251, 264, 236; 123/568.18; 188/378; 60/324

See application file for complete search history.

(56) References Cited

U.S. PATENT DOCUMENTS

| | | | | |
|---|---|---|---|---|
| 1,613,322 | A * | 1/1927 | Goetz | 181/254 |
| 1,709,426 | A * | 4/1929 | Beery | 181/254 |
| 1,832,090 | A * | 11/1931 | Branche | 251/11 |
| 2,072,372 | A * | 3/1937 | Riethmiller | 181/264 |
| 2,268,806 | A * | 1/1942 | Curtis | 137/527 |
| 2,380,374 | A * | 7/1945 | Anderson | 123/552 |
| 2,855,283 | A * | 10/1958 | Schumacher | 48/184 |
| 2,986,373 | A * | 5/1961 | Masheder | 251/248 |
| 3,020,980 | A * | 2/1962 | Baker et al. | 188/378 |
| 4,378,003 | A * | 3/1983 | Imamura | 60/324 |
| 4,541,506 | A * | 9/1985 | Venning et al. | 181/254 |
| 4,563,605 | A * | 1/1986 | Gerber | 310/74 |
| 4,825,983 | A * | 5/1989 | Nakanishi | 188/378 |
| 5,355,673 | A * | 10/1994 | Sterling et al. | 60/324 |
| 5,813,380 | A * | 9/1998 | Takahashi et al. | 123/184.55 |
| 5,839,489 | A * | 11/1998 | Ganachaud et al. | 141/382 |
| 5,931,052 | A * | 8/1999 | Zhao et al. | 74/574.4 |
| 5,971,859 | A * | 10/1999 | Runge et al. | 464/180 |
| 5,984,045 | A * | 11/1999 | Maeda et al. | 181/254 |
| 6,189,650 | B1 * | 2/2001 | Inuzuka et al. | 181/254 |
| 6,499,562 | B1 * | 12/2002 | Elfinger et al. | 181/251 |
| 6,536,567 | B2 * | 3/2003 | Nakanishi | 188/378 |
| 6,581,721 | B2 * | 6/2003 | Nagai et al. | 181/237 |
| 6,604,516 | B1 * | 8/2003 | Krimmer et al. | 123/568.18 |
| 6,637,545 | B1 * | 10/2003 | Jonsson et al. | 181/237 |
| 6,732,511 | B2 * | 5/2004 | Unbehaun et al. | 60/324 |
| 7,182,171 | B2 * | 2/2007 | Weinert et al. | 181/237 |
| 7,434,570 | B2 * | 10/2008 | Hill | 123/568.18 |
| 2006/0272322 | A1 * | 12/2006 | Abram et al. | 60/324 |
| 2008/0223025 | A1 * | 9/2008 | Hill | 60/324 |
| 2009/0127023 | A1 * | 5/2009 | Abram et al. | 181/232 |

* cited by examiner

*Primary Examiner*—Jeffrey Donels
*Assistant Examiner*—Christina Russell
(74) *Attorney, Agent, or Firm*—Harness, Dickey & Pierce, P.L.C.

(57) ABSTRACT

Snap action valve assemblies for use in conduits of automotive exhaust systems have their operation controlled by use of inertia damper elements coupled to an axle of a rotatable valve plate of the valve assembly.

5 Claims, 3 Drawing Sheets

SNAP ACTION VALVE WITH INERTIA DAMPER

FIELD

Figure 1:
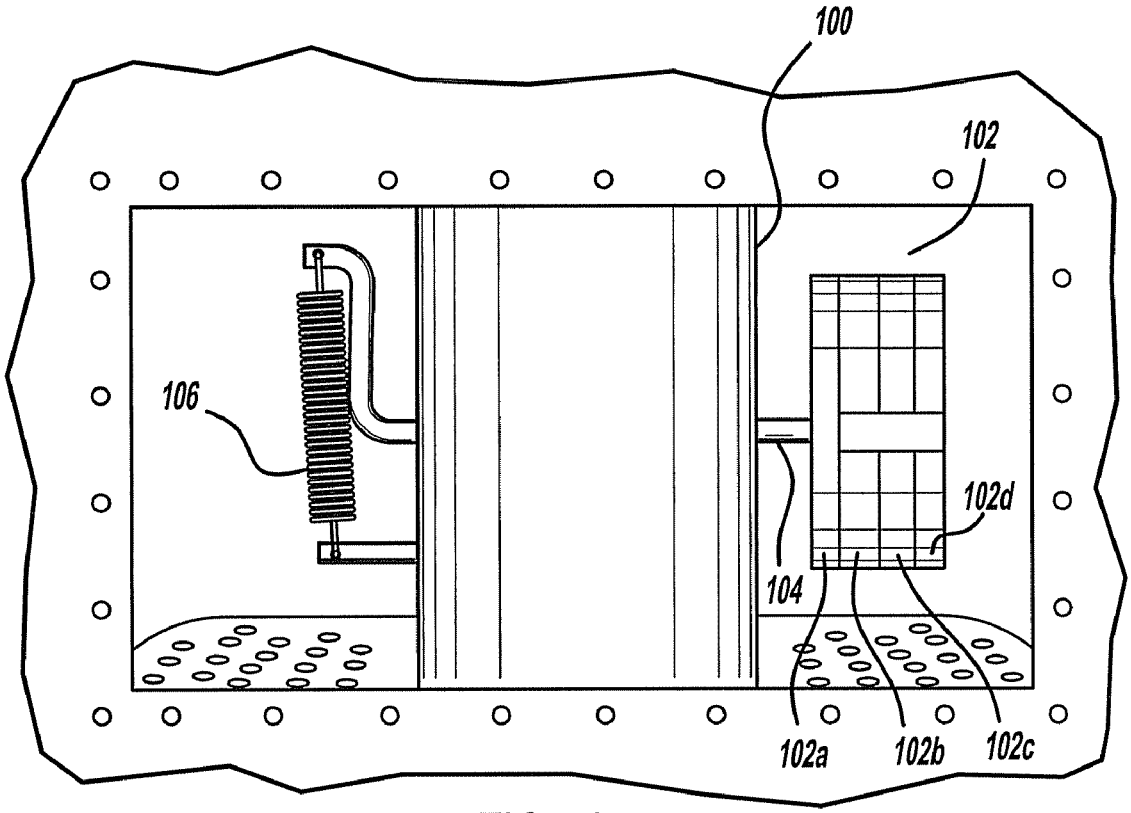

The present disclosure relates to improving flapper valve motion with an inertial damper.

BACKGROUND

This section provides background information related to the present disclosure which is not necessarily prior art.

Inertia dampers are known for smoothing the output of rotary stepper motors and the like, but, to date, no such elements have been used with rotary valve elements for automotive exhaust systems, such as snap-action valves with a rotary valve plate and a bias return spring. Such valves can present vibration and noise problems while rotating due to resonance of the valve flap and bias spring.

SUMMARY

This section provides a general summary of the disclosure, and is not a comprehensive disclosure of its full scope or all of its features.

In one aspect of the present teachings, in a valve assembly including a valve plate rotatable about an axle and a bias return spring coupled to a first end of the axle, an inertia damping element coupled to a second end of the axle is provided.

In a second aspect of the invention, a muffler for an internal combustion engine exhaust system includes a housing having an outer shell and input and output headers enclosing opposite ends of the shell. A conduit is positioned within the housing and a valve assembly having a valve flap is positioned inside the conduit for rotation about an axle pivotally coupled to the conduit between a fully closed position wherein a first peripheral portion of the valve flap is in contact with an inner surface of the conduit and a fully open position wherein a plane of the valve flap is substantially parallel to a longitudinal axis of the conduit and a second peripheral portion of the valve flap is in contact with an inner surface of the conduit. An inertia damper element is coupled to an end of the axle.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 2A:
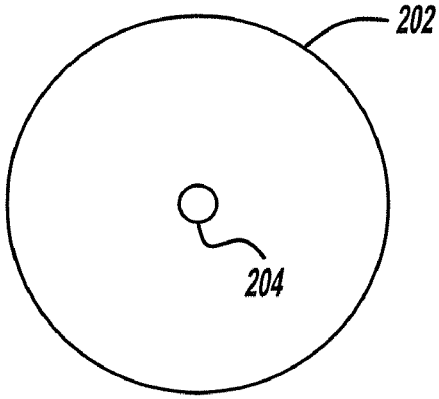
Figure 3A:
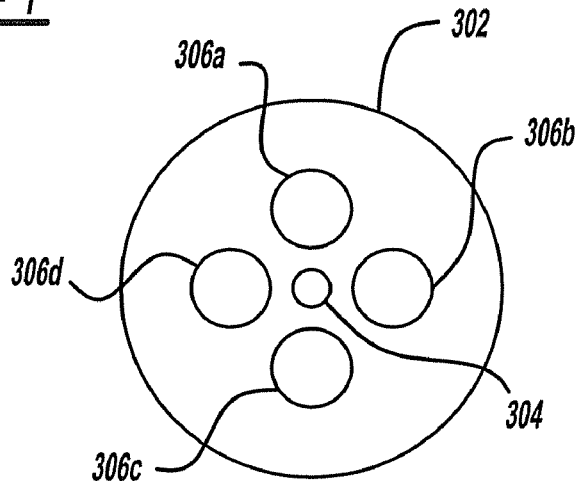
Figure 2B:
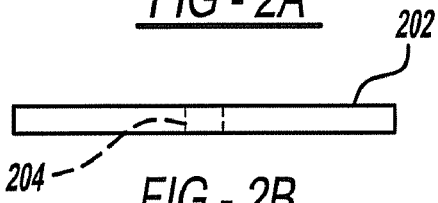
Figure 3B:
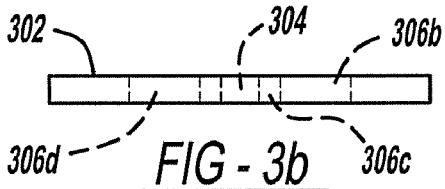
Figure 4A:
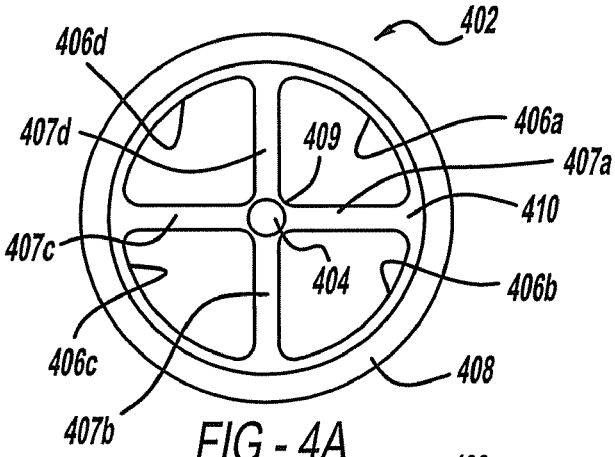
Figure 5A:
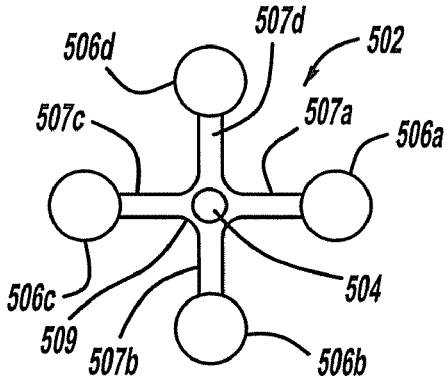
Figure 4B:
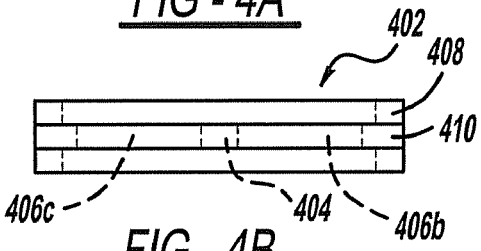
Figure 5B:
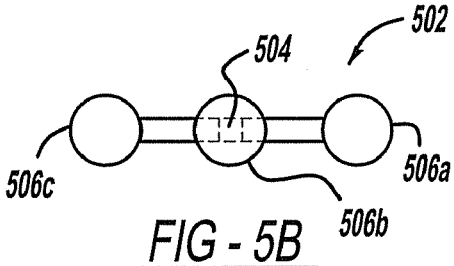
Figure 6A:
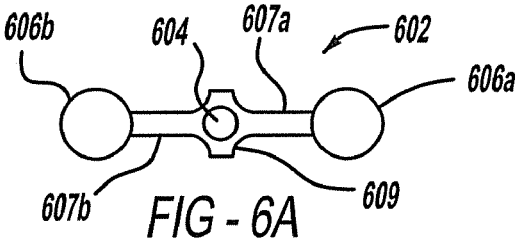
Figure 6B:
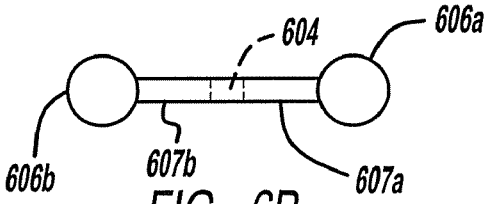
Figure 7A:
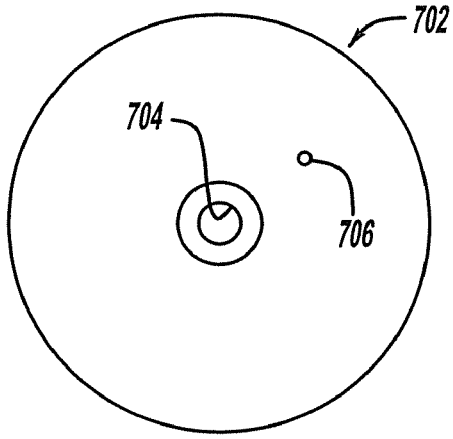
Figure 7B:
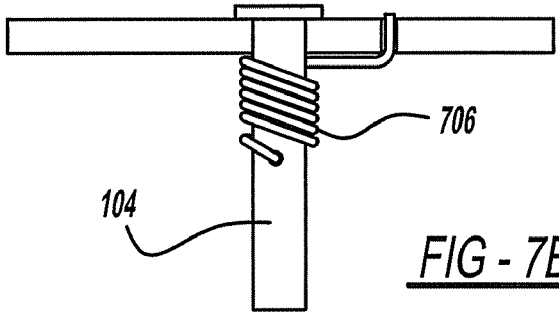
Figure 8:
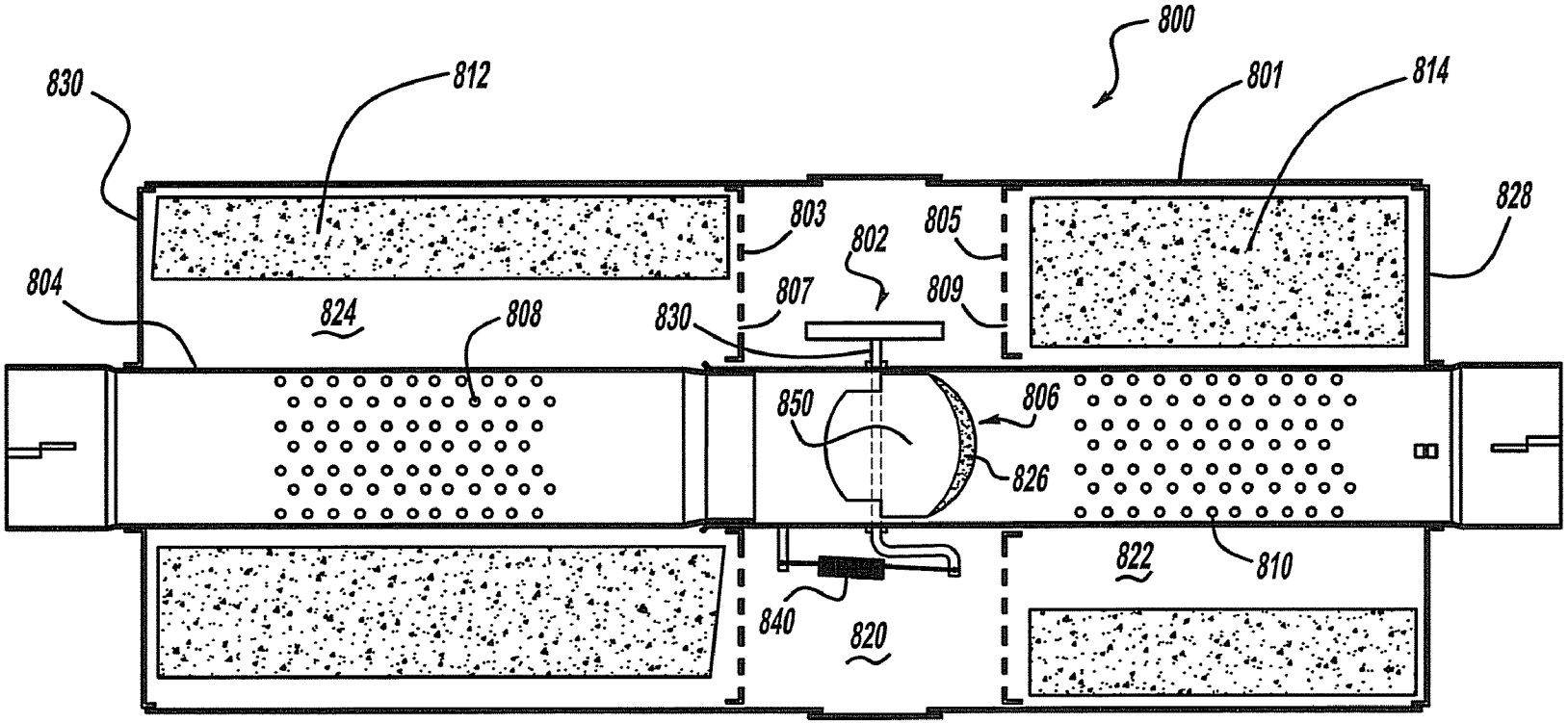

The objects and features of the present teachings will become apparent from a reading of a detailed description taken in conjunction with the drawing, in which:

FIG. 1 presents a plan view of a muffler conduit in which a snap action valve is mounted and equipped with an inertial damper element arranged in accordance with the present teachings;

FIGS. 2A, 2B present respective front and side plan views of an embodiment of a damper disk arranged in accordance with the present teachings;

FIGS. 3A, 3B present respective front and side plan views of a first alternative embodiment of a damper disk having reduced weight;

FIGS. 4A, 4B present respective front and side plan views of a second alternative embodiment of a damper element arranged in accordance with the present teachings;

FIGS. 5A, 5B present respective front and side plan views of a third alternative embodiment of a damper element arranged in accordance with the present teachings;

FIGS. 6A, 6B present respective front and side plan views of a fourth alternative embodiment of a damper element arranged in accordance with the present teachings;

FIGS. 7A, 7B present respective front and side plan views of a fifth embodiment of a damper element arranged in accordance with the present teachings; and FIG. 8 is a side cross-sectional view of a muffler housing a snap action valve equipped with an inertia damper element arranged in accordance with the present teachings.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

With reference to FIG. 1, muffler conduit 100 houses a snap action valve (whose valve plate is not shown). The valve is equipped with an inertial damper element 102 mounted to one end of valve axle 104 and a bias return spring 106 coupled between an opposite end of axle 104 and a spring mounting post coupled to the conduit 100. Preferably, damper element 102 is mounted to valve axle 104 by welding.

In the embodiment of FIG. 1, inertial damper assembly 102 is comprised of a plurality of substantially solid disk elements 102*a, b, c* and *d*. Each disk is as shown in FIGS. 2A and 2B a substantially solid disk 202 having a central aperture 204 for receipt of axle 104. Any number of such disks can be utilized in obtaining the precise weight of the damper element desired.

There are other approaches to adjusting the weight of the inertia damper element, some of which are set forth in the embodiments of FIGS. 3A, B through 6A, B.

In the embodiment of FIGS. 3A, B, damper disk body 302 has its weight adjusted by providing a plurality (in this case four) of through apertures 306*a, b, c* and *d*. These apertures are spaced substantially uniformly about a central aperture 304 for receipt of the valve axle.

FIGS. 4A, B present a "steering wheel"-type approach to weight adjustment wherein damper element 402 has a rim 410 with spokes 407*a, b, c* and *d* extending inwardly from radially inner surfaces 406*a, b, c* and *d* of rim 410 to a central axle mounting hub 409 which has a through opening 404 for receipt of the valve axle. Mounted to and surrounding rim 410 is a weight adding element 408.

In the embodiments of FIGS. 5 and 6, weighted nodules or lobes are connected to a central axle mounting hub via spoke elements. In the embodiment of FIGS. 5A, B, four such nodules 506*a, b, c* and *d* of damper element 502 are respectively coupled to central axle mounting hub 509 via spokes 507*a, b, c* and *d*. The valve axle is received through opening 504 in hub 509.

In the embodiment of FIGS. 6A, B, only two nodules 606*a* and 606*b* of damper element 602 are utilized, and each are coupled to an axle mounting hub 609 via spokes 607*a* and 607*b*. Through passage 604 in hub 609 receives the valve axle.

The inertia damper elements described above with reference to FIGS. 1-6 provide a simple mass welded to the valve axle and they all tend to damp all vibrations present in the valve system. An alternative is a tuned damper set forth in FIGS. 7A, B. In this arrangement, a tuning coil spring 706 is utilized in conjunction with disk elements to address specific frequencies at resonance of the system. The spring rate and mass of the damping element can be varied in known approaches to minimizing vibrations at resonance. As seen from FIGS. 7A, B, rather than connecting damper element 702 directly to axle 104, coil spring 706 has one end embedded in an aperture in damper disk 702 and has its opposite end embedded in valve axle 104. Spring 706 has most of its body coiled around axle 104. Disk 702 is provided with a central aperture 704 for receipt of valve axle 104. Disk 702 is rotatably movable with respect to axle 104.

FIG. 8 depicts one exemplary application of a snap action valve with damper element used in a automotive muffler 800.

Muffler 800 includes a housing shell 801 closed at either end by an input header 830 and an output header 828.

A through conduit 804 is positioned within muffler 800 and in this embodiment extends clear through the muffler body. Conduit 804 includes a first series of perforations 808 and a second plurality of perforations 810. Inside muffler housing 801 a first internal partition 803 defines chamber 824 with input header 830 and shell 801. Internal partition 805 defines chamber 822 in conjunction with output header 828 and shell body 801. Perforations 808 allow communication between exhaust flowing through conduit 804 and chamber 824 which is filled with sound absorbing material 812 such as fiberglass roving.

Similarly, the second plurality of perforations 810 in conduit 804 provide fluid communication between the exhaust in conduit 804 and chamber 822 which is filled with sound absorbing material 814.

Openings 807 in partition 803 permit fluid communication between chambers 824 and 820, while openings 809 in partition 805 permit fluid communication between chambers 820 and 822.

Rotary snap action valve assembly 806 includes a valve plate 850 carrying a vibration absorbing damper pad 826 about a portion of its periphery which would normally be in contact with an interior surface of conduit 804 in a closed position of the valve. At one end of an axle 830 of the valve inertia damper element 802 is mounted, while at an opposite end of the axle 830 a return bias spring 840 is shown. Valve assembly 806 is housed in chamber 820 located between partitions 803 and 805 and this chamber is free from sound absorbing material in this embodiment. When the pressure of the exhaust flowing through conduit 804 reaches a threshold value, the mass of the valve assembly 806 is overcome and the valve plate 850 is swung toward a full open position. This valve motion is smoothed by the braking action of inertia damper element 802.

The various embodiments of inertia dampers disclosed add braking mass to the valve to reduce the amplitude of the resonance vibration of the valve flap and bias spring.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A valve assembly for reducing engine exhaust noise exiting a conduit, the valve assembly comprising:

a rotatable axle adapted to be mounted to the conduit;

a valve plate fixed for rotation with the axle;

a return spring having a first end coupled to the axle and a second end adapted to be coupled to the conduit, the return spring biasing the valve plate toward a closed position;

a tuned damper assembly including an inertia damping element rotatably coupled to the axle and a damping spring having a first portion coupled to the damping element and a second portion coupled to the axle.

2. The valve assembly of claim 1 wherein the damping spring includes a coil spring having one end positioned in an aperture of the inertia damping element.

3. The valve assembly of claim 2 wherein the damping spring includes multiple coils surrounding the axle.

4. The valve assembly of claim 3 wherein the inertia damping element includes a substantially cylindrical shape having a central aperture in receipt of the axle.

5. The valve assembly of claim 1 wherein the mass of the damping element and the spring rate of the damping spring are set to minimize vibrations at a predetermined resonance.

* * * * *